United States Patent [19]

Moore

[11] Patent Number: 4,638,581

[45] Date of Patent: Jan. 27, 1987

[54] AMBIDEXTEROUS MAGAZINE CATCH

[76] Inventor: Wildey J. Moore, 610 Bloomingrove Tpk., New Windsor, N.Y. 12550

[21] Appl. No.: 666,201

[22] Filed: Oct. 31, 1984

[51] Int. Cl.[4] ..... F41C 25/06

[52] U.S. Cl. ..... 42/7

[58] Field of Search ..... 42/7, 6

[56] References Cited

U.S. PATENT DOCUMENTS 3,372,506 3/1968 Wilhelm ..... 42/7

4,326,353 4/1982 Ludwig et al. ..... 42/7

FOREIGN PATENT DOCUMENTS 2137321 10/1984 United Kingdom ..... 42/7

*Primary Examiner*—Charles T. Jordan

*Attorney, Agent, or Firm*—McCormick, Paulding & Huber

[57] ABSTRACT

A pistol having a frame including a grip portion defining a magazine well and a trigger guard portion forward of the magazine well. A magazine catch disposed within an opening which extends transversely through the frame is biased toward a magazine retaining position and generally restrained against lateral movement relative to the frame. The magazine catch is further supported on the frame for pivotal movement about either one of its ends and toward a magazine releasing position in response to forwardly directed force applied to the end of the said catch opposite said one end.

8 Claims, 8 Drawing Figures

AMBIDEXTEROUS MAGAZINE CATCH

BACKGROUND OF THE INVENTION

This invention relates in general to magazine catches for firearms and deals more particularly with an improved ambidextrous magazine catch. The magazine catches provided on most firearms are handed and usually set-up for right-hand operation. Where provision is made for left-hand operation it is usually necessary to remove the magazine catch and reassemble it with the firearm in a left-handed operating position. However, this arrangement is often inconvenient, particularly where the firearm is to be used by more than one person, as, for example, in a training session during which several persons may be required to operate the same gun.

Accordingly, it is the general aim of the present invention to provide an improved, reliable ambidextrous magazine catch of durable construction.

SUMMARY OF THE INVENTION

In accordance with the present invention, an improved magazine catch is provided for a firearm which includes a frame defining a magazine well and a catch member supported within an opening extending transversely through the frame forward of the magazine well for movement between magazine retaining and magazine releasing positions relative to a magazine contained within the well. The improved catch comprises means for restraining said catch member against substantial lateral movement relative to the frame and means for supporting said catch member within said opening to pivot about either one of its ends from a magazine retaining position to a magazine releasing position in response to force applied in a forward direction to the end of said catch member opposite said one end.

DETAILED DESCRIPTION OF PREFERRED EMBODIMENT

Figure 3:
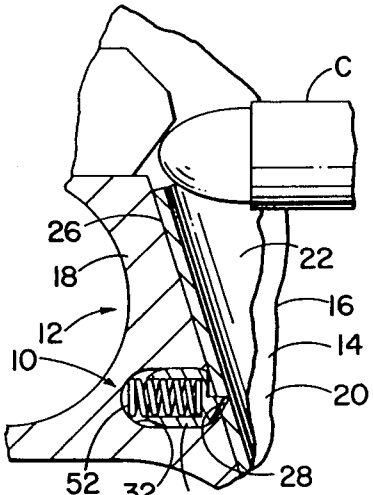
FIG. 3 is a fragmentary sectional view taken along the line 3—3 of FIG. 2.
Figure 1:
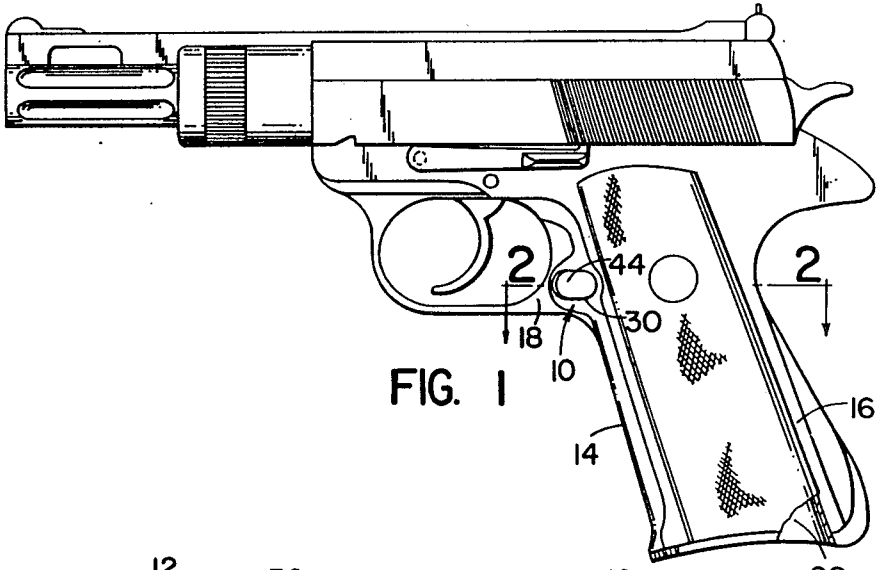
FIG. 1 is a fragmentary side elevational view of a hand gun embodying the present invention.

Referring now to the drawing, an ambidextrous magazine catch embodying the present invention and indicated generally by the reference numberal 10 is illustrated with reference to a firearm or handgun designated generally by the numeral 12. The handgun 12 has a frame indicated generally at 14 which includes a grip portion 16 and an integral trigger guard 18 located forward of the grip portion. A magazine well 20 formed in the grip portion opens through the lower or butt end of the grip portion and receives a magazine, indicated generally at 22, which contains a supply of cartridges such as the cartridge indicated at C. The magazine 22 is releasably retained in assembly with the handgun by the magazine catch 10 and has an integral rib 26 with a notch 28 formed in it for cooperating with the magazine catch, as will be hereinafter further discussed.

Considering now the construction and arrangement of the magazine catch in further detail, the catch 10 comprises an elongated catch member 30 supported within an opening 32 formed within and extending transversely through the frame forward of the magazine well 20 and within the region of the trigger guard portion 18.

Figure 2:
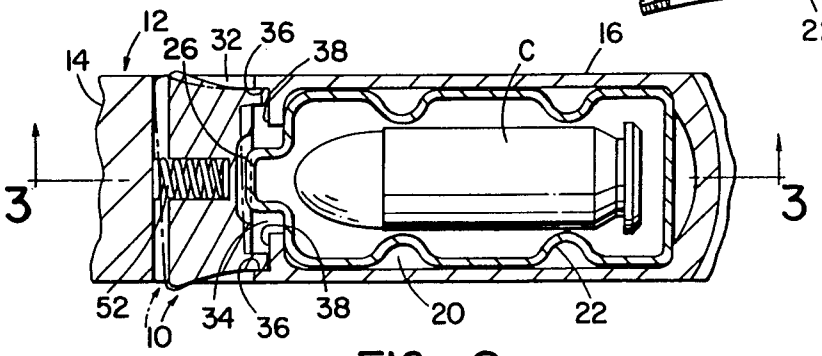
FIG. 2 is a somewhat enlarged fragmentary sectional view taken along the line 2—2 of FIG. 1.
Figure 8:
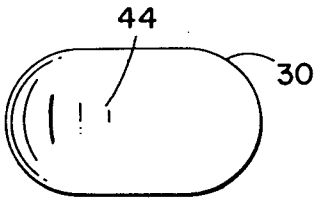
FIG. 8 is a side elevational view of the magazine catch.
Figure 6:
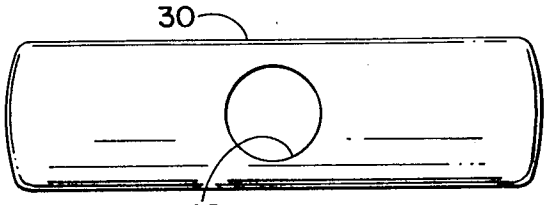
FIG. 6 is a front elevational view of the magazine catch.
Figure 7:
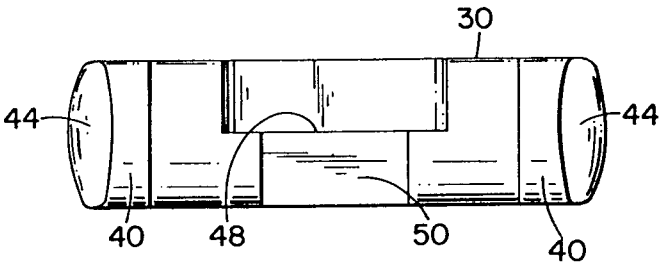
FIG. 7 is a rear elevational view of the magazine catch.

The frame 14 also has a recess 34 which communicates with the opening 32 and with the magazine well 20. The recess 34 is defined, in part, by a pair of opposing laterally spaced apart side surfaces 36, 36 and a pair of laterally spaced apart and forwardly facing rear surfaces 38, 38. Each rear surface 38 forms a junction with an associated side surface 36, as best shown in FIG. 2.

Figure 4:
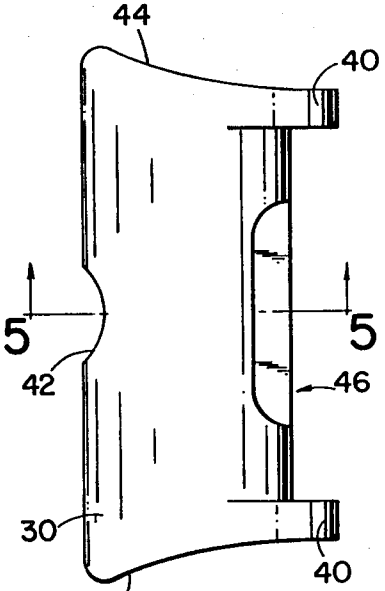
FIG. 4 is a somewhat enlarged plan view of the magazine catch shown in FIG. 1.
Figure 5:
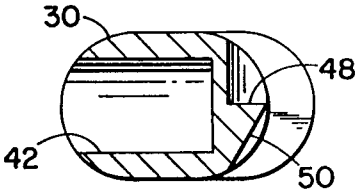
FIG. 5 is a sectional view taken along the line 5—5 of FIG. 4.

Referring now to FIGS. 4–8, the catch member 30 comprises an elongated member which has a generally oval cross section. A pair of laterally spaced apart fulcrum portions 40, 40 project rearwardly from opposite ends of the catch member, as best shown in FIG. 4. A forwardly opening blind bore 42 opens through the central portion of the catch member front wall. The opposite ends of the catch member 30 define generally vertically disposed button surfaces 44, 44 which curve forwardly and acutely outwardly from the rearwardly projecting fulcrum portions, as shown in FIGS. 2 and 4. A rearwardly facing latch, indicated generally at 46, is formed on a central portion of the catch member by a horizontally disposed top surface 48 and a rearwardly facing surface 50 inclined downwardly and forwardly from the rear edge of the surface 48. The latch 46 is shaped to substantially compliment the notch 28.

The catch member 30 is mounted within the opening 32 with the fulcrum portions 40, 40 disposed within the recess 34 between the opposing side surfaces 36, 36. A coil spring 52, received within the bore 42, bears against the frame and biases the latch member to a magazine retaining position, shown in full lines in FIG. 2. In the latter position the latch 46 is engaged within the notch 28 and the fulcrum portions 40, 40 into engagement or at least near engagement with the rear surface 38, 38.

The side surfaces 36, 36 cooperate with the fulcrum portions 40, 40 to restrain the magazine catch member against substantial lateral movement relative to the frame 14. The opposite ends of the catch member 30 project outwardly in opposite directions from the opening 32 so that the button surfaces 44, 44 are exposed externally of the frame 14.

When a magazine 22 is inserted into the magazine well 20, the rib 26 engages the inclined latch surface 50 to bias the magazine catch member 30 in the forward direction within the opening 32 against the biasing force exerted by the spring 52. When the magazine 22 is properly positioned within the magazine well, the latch 46 is engaged within the complementary notch 28 and retains the magazine in its proper position within the well 20. The magazine 22 may be released from the well by applying forwardly directed force to the button surface 44 at either end of the catch member 30 which causes the catch to pivot about the fulcrum portion 44 at its opposite end and to a magazine releasing position shown in broken lines in FIG. 2 wherein the latch 46 is disposed forwardly of the notch 28 which allows the magazine to drop out of the magazine well.

The invention has been illustrated and described with reference to a handgun or a pistol. However, it should be understood that the ambidextrous magazine catch of the present invention may be used on virtually any firearm which includes a releasably retained magazine.

I claim:

1. In a firearm having a frame defining a magazine well for receiving a magazine therein, and a magazine catch supported within an opening in the frame and moveable between a magazine retaining position wherein the magazine catch is engaged with an associated portion of a magazine contained within said well and a magazine releasing position wherein the magazine catch is out of engagement with the associated portion, the improvement wherein said magazine catch comprises a unitary member having supporting and restraining means integrally formed thereon for supporting said magazine catch on said frame to pivot within said opening about either one of its ends and to said magazine releasing position in response to force applied to the other one of its ends and restraining said magazine catch against substantial lateral movement relative to said frame, and means for biasing said magazine catch toward its magazine retaining position.

2. In a firearm as set forth in claim 1 the further improvement wherein said biasing means comprises a spring acting between said magazine catch and said frame.

3. In a firearm as set forth in claim 2 the further improvement wherein said magazine catch has a recess therein receiving an associated protion of said spring.

4. In a firearm as set forth in claim 1 the further improvement wherein said supporting and restraining means comprises a pair of laterally spaced apart and rearwardly projecting portions of said magazine catch for cooperating with associated portions of said frame.

5. In a firearm as set forth in claim 4 the further improvement wherein said frame defines a recess communicating with said opening and with said magazine well and said associated portions of said frame comprise walls of said recess.

6. In a firearm as set forth in claim 5 the further improvement wherein said walls of said recess comprise laterally spaced apart and forwardly facing walls and laterally spaced apart opposing walls.

7. In a pistol having a frame including a grip portion and a trigger guard portion forward of said grip portion, said grip portion defining a magazine well, said frame having an opening extending transversally therethrough forward of said grip portion and in the region of said trigger guard portion, and a magazine catch member supported by said frame within said opening for movement between magazine retaining and magazine releasing positions, the improvement comprising said frame having a forwardly opening recess communicating with said magazine well and with said opening and partially defined by a pair of laterally spaced apart opposing sidewalls and a pair of laterally spaced apart and forwardly facing rear walls, each of said rear walls forming a junction with an associated one of said sidewalls, said magazine catch member comprising a unitary member having integral laterally spaced part and rearwardly extending fulcrum portions extending into said recess and disposed between said side walls, each of said fulcrum portions being engagable with an associated one of said rear walls, a spring acting between said frame and a forwardly facing central portion of said magazine catch member and biasing said magazine catch member toward said magazine retaining position and said fulcrum portions toward engagement with said rear walls, said fulcrum portions cooperating with said sidewalls to restrain said magazine catch member against substantial lateral movement relative to said frame, said magazine catch member being pivotally movable about one of said fulcrum portions at an associated end of said magazine catch member and to a magazine releasing position in response to forwardly directed force applied to the end of said magazine catch member opposite said associated end.

8. In a firearm having a frame defining a magazine well for receiving a magazine therein, a magazine catch supported within an opening in the frame for movement relative to the frame between a magazine retaining position wherein the magazine catch is engaged with an associated portion of a magazine received within the magazine well and a magazine releasing position wherein said magazine catch is out of engagement with said associated portion, the improvement comprising said frame having a recess therein communicating with said magazine well and said opening and said magazine catch comprising an elongated unitary member extending transversally of said frame within said opening and having opposite ends exposed at opposite ends of said opening, said magazine catch having integral fulcrum means extending into said recess for supporting said magazine catch on said frame to pivot within said opening about either one of its ends and to a magazine releasing position in response to pressure applied to the other one of its ends and restraining said magazine catch against substantial lateral movement within said opening and relative to said frame.

* * * * *